US006272874B1

(12) United States Patent
Keeney

(10) Patent No.: US 6,272,874 B1
(45) Date of Patent: Aug. 14, 2001

(54) PASSENGER COOLING DEVICE FOR WATERCRAFT

(76) Inventor: Bart Keeney, 3125 County Rd. 805B, Cleburne, TX (US) 76031

( * ) Notice: Subject to any disclaimer, the term of this patent is extended or adjusted under 35 U.S.C. 154(b) by 0 days.

(21) Appl. No.: 09/483,757

(22) Filed: Jan. 14, 2000

(51) Int. Cl.[7] ..... B63J 2/04

(52) U.S. Cl. ..... 62/240; 62/259.4; 62/314; 261/117

(58) Field of Search ..... 62/240, 259.4, 62/314; 261/117, DIG. 3, DIG. 43

(56) References Cited

U.S. PATENT DOCUMENTS 1,884,534 * 10/1932 Betz ..... 62/259.4
2,141,855 * 12/1938 Dodge ..... 62/259.4
2,628,483 * 2/1953 Garnier ..... 62/240
4,308,222 * 12/1981 Goettel et al. ..... 62/314
4,549,406 * 10/1985 Ebner et al. ..... 62/259.4
5,046,449 9/1991 Nelson ..... 118/315
5,299,960 4/1994 Day et al. ..... 440/38
5,613,371 * 3/1997 Nelson ..... 62/259.4
5,752,662 5/1998 Hsu ..... 239/29
6,112,538 * 9/2000 Strussion ..... 62/314

* cited by examiner

*Primary Examiner*—William E. Tapolcoi
(74) *Attorney, Agent, or Firm*—Bracewell & Patterson, LL

(57) ABSTRACT

A passenger cooling device for use on a watercraft in a body of water, the passenger cooling device comprising a fan member and a mist assembly associated with the fan member. The mist assembly includes a nozzle, a pump for pumping water from the body of water through the mist assembly to form a vapor mist, and a filter member for filtering solids from the water. The nozzle and fan member are aligned, such that the vapor mist is directed toward passengers on the watercraft. An intake conduit extends from the pump into the body of water.

20 Claims, 3 Drawing Sheets

PASSENGER COOLING DEVICE FOR WATERCRAFT

BACKGROUND ART

1. Field of the Invention

The present invention relates generally to personal cooling devices, and in particular, to personal cooling devices that utilize fans and water mist.

2. Description of Related Art

Personal cooling devices utilizing fans and water mist have been used in hot-weather conditions for some time. The combination of a fine spray mist and increased air flow facilitates evaporation from the skin and, in turn, lowers the skin and body temperature of persons in the immediate fan environment. Large box-type fans were outfitted with drip systems or mist nozzles to create an additional cooling effect. Such cooling devices are used at athletic events to help cool both the athletes and spectators in hot weather. Although these devices can be used to cool several people at once, they are bulky and take up a large amount of space.

The concept of combining spray mist with a fan was scaled down to the individual level by equipping small, hand-held pump-spray bottles with small electrical fans. The fan blades on these devices are relatively small and often made of soft plastic or foam rubber to prevent injury to the user. Although these devices are portable, their capacity is limited because the volume of the spray bottle must be kept low due to the weight of the water. If the volume of the spray bottles exceed a quart or so, the bottle becomes too heavy to carry conveniently. In addition, these hand-held devices are usually powered by low-power batteries, thereby limiting the operational life of the devices.

During the summer, the decks of commercial and recreational watercraft can be unbearably hot. Unfortunately, the above devices offer little or no relief for watercraft passengers. The large box-type fans with drip or mist systems cannot fit into the limited space on the deck of these watercraft, and the small hand-held devices simply do not have adequate capacity, as measured by either the volume of water available, or by their electrical operational lives to keep the passengers cool.

Therefore, although these devices represent significant development in the area of personal cooling devices, significant shortcomings remain, particularly in the area of passenger cooling devices for use on commercial and recreational watercraft. This is especially true in the case of watercraft with large, flat exposed passenger decks which craft are anchored for significant periods of time in use, such as with the modern bass boat.

BRIEF SUMMARY OF THE INVENTION

There is a need for a passenger cooling device for use on a watercraft, the passenger cooling device being powered by the watercraft's existing electrical power supply and having a large water capacity.

Because such a need exists, it is an object of the present invention to provide a passenger cooling device for use on a watercraft, the passenger cooling device being connected to the watercraft's existing electrical power supply, the passenger cooling device having a fan member, a mist assembly operably associated with the fan member, and a pump member that pumps water from an available source such as from the body of water in which the watercraft is afloat through the mist assembly.

It is another object of the present invention to provide a passenger cooling device for use on a watercraft, the passenger cooling device being connected to the watercraft's existing electrical power supply, the passenger cooling device having a fan member, a mist assembly operably associated with the fan member, a pump member that pumps water from the body of water in which the watercraft is afloat through either the mist assembly or into a reservoir on the watercraft, and a switch valve for selectively determining whether the pump member pumps water through the mist assembly or the into the reservoir.

It is another object of the present invention to provide a passenger cooling device for use on a watercraft, the passenger cooling device being connected to the watercraft's existing electrical power supply, the passenger cooling device having a fan member, a mist assembly operably associated with the fan member, a pump member that pumps water from a separate reservoir on the watercraft in the vicinity of the pump through the mist assembly.

The above objects are achieved by providing a passenger cooling device that detachably connects to an existing electrical receptacle on a watercraft, such as a receptacle for a detachable running light. The passenger cooling device has an electrical fan member carried by an adjustable mast and a mist assembly featuring an atomizing nozzle. The mist assembly is operably associated with the fan member. The passenger cooling device has a pump member that draws water from the body of water in which the watercraft is afloat and pumps the water through the atomizing nozzle. In an alternate embodiment, a switch valve is added to allow an existing pump member to supply water to either the passenger cooling device or an existing reservoir on the watercraft, such as a live well. In another embodiment, the pump is used to pump water directly from a reservoir on the boat to the atomizing nozzle.

The present invention provides significant advantages. The passenger cooling device can cool several people at once and has an unlimited water capacity because, in a preferred embodiment, it draws water from the body of water in which the watercraft is afloat. Because the passenger cooling device of the present invention is powered by the watercraft's existing high-power, electrical power supply, it has a relatively long operational life. Under typical conditions, the passenger cooling device can provide a cooling effect of approximately 20° F.

These and other objects and advantages of the present invention will be apparent in the following detailed description when read in conjunction with the accompanying drawings.

BRIEF DESCRIPTION OF THE DRAWINGS

The novel features believed characteristic of the invention are set forth in the appended claims. The invention itself however, as well as a preferred mode of use, will best be understood by reference to the following detailed description of an illustrative embodiment when read in conjunction with the accompanying drawings, wherein:

DETAILED DESCRIPTION OF THE PREFERRED EMBODIMENT

Figure 1:
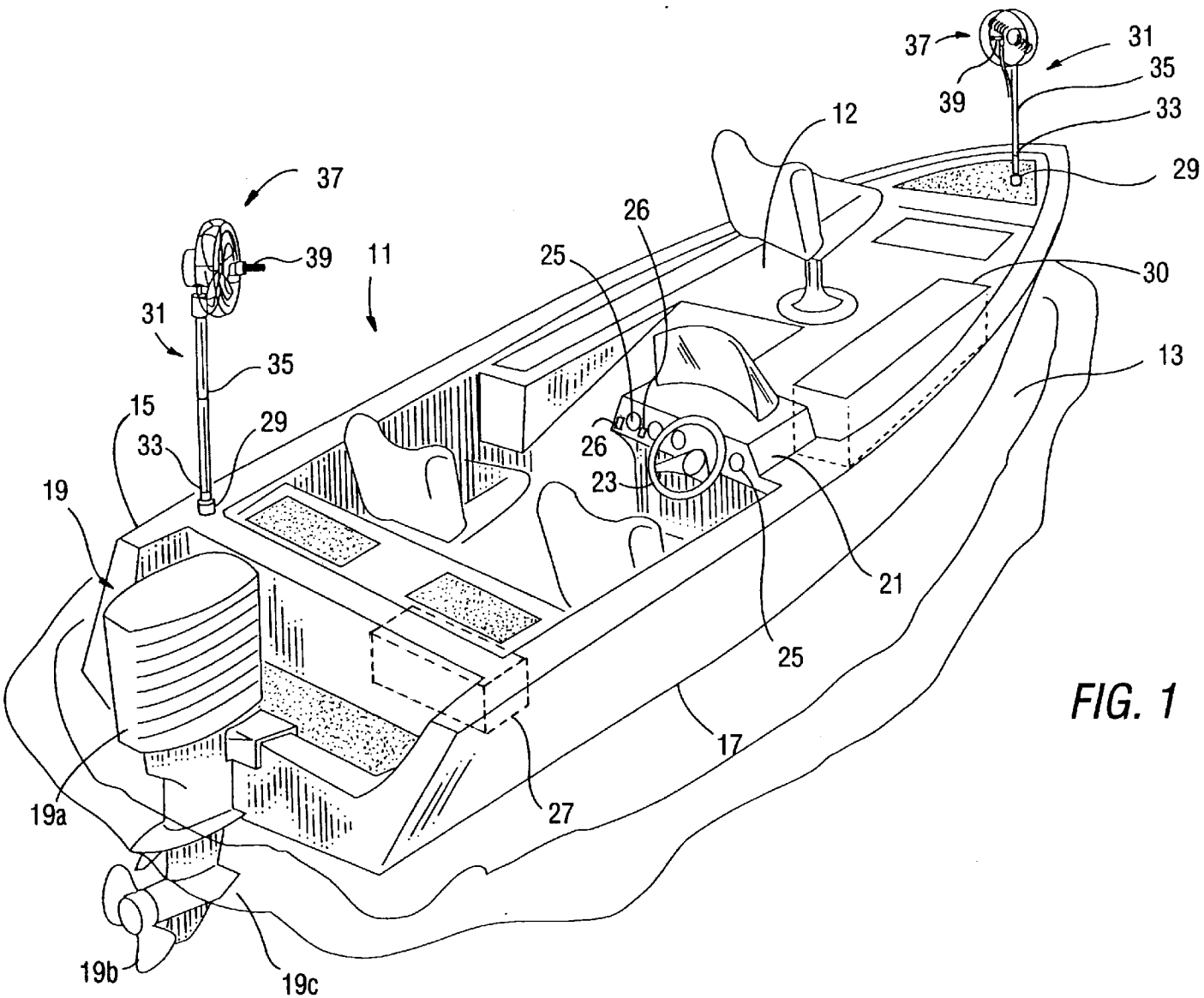
FIG. 1 is a perspective view of a watercraft having passenger cooling devices according to the present invention.

Referring to FIG. 1 in the drawings, the preferred embodiment of the passenger cooling device for watercraft is illustrated. A conventional watercraft 11 is shown afloat in a body of water 13. Although watercraft 11 is shown as an outboard motor boat, it should be understood that watercraft 11 may be any one of a wide variety of watercraft including: sailboats, jet boats, or other watercrafts, such as john boats, jet skis, or canoes, either recreational or commercial. Body of water 13 is body of water in which watercraft 11 is afloat, such as streams, rivers, lakes, aquifers, seas and oceans.

Watercraft 11 includes a conventional hull 15, typically made of fiberglass, wood, or aluminum, or other suitable materials. Watercraft 11 is designed to remain afloat at a predetermined level, thereby defining a predetermined water line 17. Thus, hull 15 is partially above water line 17 and partially below water line 17. Hull 15 carries a propulsion means 19, in this case, a gasoline-powered outboard engine 19*a,* having a propeller 19*b*. Propulsion means 19 may also be a diesel engine, a jet engine, a system of sails, or an electric motor, such as a trolling motor. Often, propulsion means 19 includes a steering mechanism 19*c,* in this case a fin or rudder. Usually, propulsion system 19 and steering mechanism 19*c* are operated by an operator (not shown) from a console 21. Console 21 includes conventional control devices, such as a steering wheel 23 for controlling steering mechanism 19*c,* switches 26, and gages 25 for monitoring the status and performance of propulsion means 19 and other components of watercraft 11. It is common for watercraft 11 to include an electrical power source 27, for example a 12-Volt DC battery. Power source 27 is conductively coupled to propulsion means 19 and other electrical components by leads (not shown) which are usually concealed below an upper deck 12 of watercraft 11.

Watercraft 11 usually includes one or more conventional electrical receptacles 29 that are conductively coupled to electrical power source 27. Electrical receptacles 29 are adapted to releasably receive detachable electrical components such as running lights (not shown). Electrical receptacles 29 typically include conventional latching mechanisms to releasably secure the electrical component in place. Electrical receptacles 29 also include conventional electrical terminators (not shown) to complete the conductive coupling between the electrical component and electrical power source 27.

Watercraft 11 may include a reservoir 30 for holding water or other fluids. For example, on fishing boats, reservoir 30 is often used a live well for bait or fish that have been caught. Reservoir 30 may be filled by hand or with the use of a pump means (see FIG. 3) that pumps water from body of water 13 through a conduit (not shown) into reservoir 30. Such a pump means would generally be operated by one of switches 26 on console 21.

As is shown in FIG. 1, the detachable electrical running lights of watercraft 11 have been replaced with a plurality of personal cooling devices 31 according to the present invention. Personal cooling devices 31 are releasably received by electrical receptacles 29. Each personal cooling device 31 includes a connector 33, a mast 35 coupled to connector 33, a fan member 37 coupled to mast 35, and a mist assembly 39 operably associated with fan member 37. Because each personal cooling device 31 is adapted to be installed in one of the plurality of electrical receptacles 29, each personal cooling device 31 independently powered by electrical power supply 27, just as a detachable running light would be powered.

Figure 2:
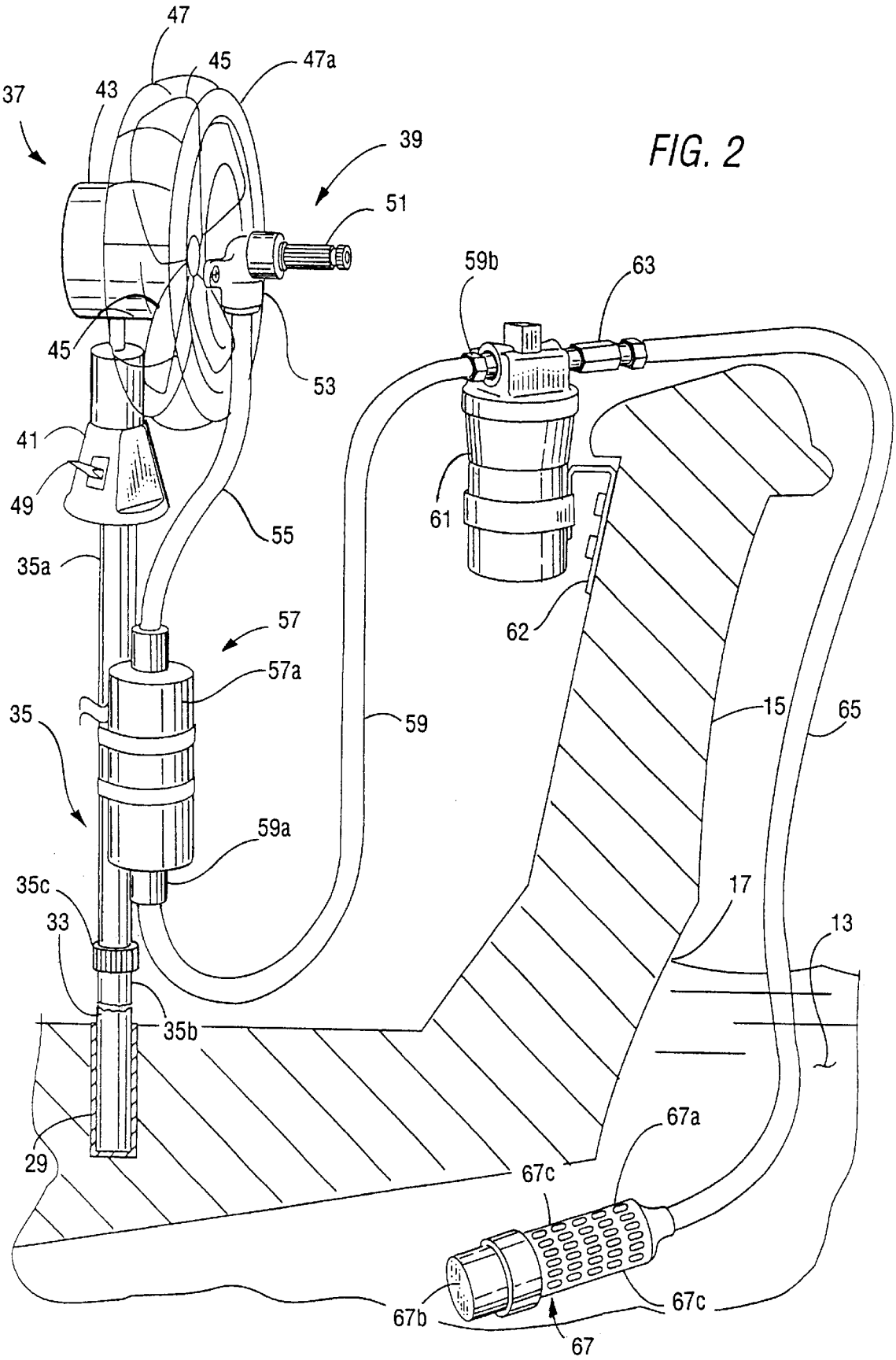
FIG. 2 is a perspective view in partial cross-section of the passenger cooling device for watercraft according to the present invention.

Referring now to FIG. 2 in the drawings, personal cooling device 31 is shown in detail. As is shown, connector 33 is releasably installed in electrical receptacle 29 in hull 15 of watercraft 11. Connector 33 includes conventional latching mechanisms (not shown) to secure personal cooling device 31 within electrical receptacle 29, and conventional electrical terminals (not shown) to ensure proper electrical conductivity between personal cooling device 31 and power supply 27 (see FIG. 1). Connector 33 may be integral with mast 35. When it is desired that the height of mast 35 be adjustable, mast 35 may be divided into an upper section 35*a* and a lower section 35*b,* in which upper section 35*a* and lower section 35*b* telescope into each other and are fastened in place by a screw-type fastening means 35*c*. It should be understood that other conventional methods of adjusting the height of mast 35 may be employed.

Fan member 37 is coupled to mast 35, and may be either a stationary fan or an oscillating fan, depending upon the desired application. Fan member 37 includes a base unit 41, an electric fan motor 43, preferably a 12-Volt, variable-speed DC motor, a plurality of fan blades 45, and a protective cage 47. Base unit 41 is generally a housing for fan motor controls and switches, such as fan motor switch 49 for switching fan motor 43 between different modes of on and off. Thus, fan motor 43 is conductively coupled to base unit 41. Protective cover 47 partially surrounds fan blades 45 and prevents operators or passengers from contacting fan blades 45. Fan blades 45 are preferably about twelve inches in diameter. It should be understood that fan member switch 49 may be located on console 21 (see FIG. 1) for added convenience.

Continuing with reference to FIG. 2, mist assembly 39 includes a nozzle 51, a connector 53, a first conduit 55, a filter member 57, a second conduit 59, a pump member 61, a quick-release connector 63, an intake conduit 65, and a screening member 67. The nozzle 51 can be formed from a variety of materials and can be supplied in a range of convenient sizes, for example, 0.007, 0.008, 0.010, 0.020 inches in diameter. Nozzle 51 is preferably an atomizing nozzle made of stainless steel or brass having an orifice about 0.007 inches in diameter that creates a fine mist, or vapor, although nozzles having other orifice sizes may be used. Nozzle 51 provides a flow rate of about 0.333 gallons of water per hour. Nozzle 51 is releasably coupled to connector 53, so that nozzle may be removed, replaced, interchanged, repaired, or unclogged, if necessary or desired. Connector 53 couples nozzle 51 to first conduit 55. First conduit 55 is preferably a conventional flexible hose having an inside diameter of about 0.375 inches. First conduit 55 should be of sufficient length to allow fan member to freely oscillate. It is preferred that connector 53 be adapted for attachment to a front surface 47*a* of protective cover 47, thereby maintaining the operable association between fan member 37 and mist assembly 39. However, it should be understood that connector 53 may be located in a variety of locations as long the mist from nozzle 51 can be projected by fan member 37 toward the passengers (not shown). For example, nozzle 51 may be located behind fan blades 45, or may be located near the edge of fan blades 45 and aimed at an angle toward the center of fan blades 45.

First conduit 55 couples connector 53 to filter member 57. Filter member 57 is preferably a conventional cartridge-type filter having a housing 57*a* and a replaceable filter element (not shown), preferably having 5-micron mesh to filter small solids from the water from body of water 13. Second conduit 59 is preferably a conventional flexible hose having an inside diameter of about 0.375 inches. Second conduit 59 extends between filter member 57 and pump member 61. Second conduit 59 may be either permanently attached to filter member 57, or releasably coupled to filter member 57 at a coupling 59*a*. Coupling 59*a* may even be a conventional quick-release coupling. Likewise, second conduit 59 may be either permanently attached to pump member 61, or releasably coupled to pump member 61 at a coupling 59*b*. Coupling 59*b* may even be a conventional quick-release coupling. Pump member 61 is preferably a 12-Volt DC, high-volume electro-mechanical pump, similar to the Type IV pump commercially available from FLOWJET of Irvine, Calif. under model 4406-143 and model name FLOWJET QUIET QUAD. Pump member 61 is preferably an "on-demand" type pump that continuously supplies water to nozzle 51 at a pre-selected pressure. Pump member 61 is preferably controlled by switch 26 on console 21, and is powered by power supply 27 of watercraft 11. Pump member 61 may also be a hand-held bulb pump, or any other manual type pump, such as a foot-pedal pump. Pump member 61 is optionally coupled to and carried by hull 15 via a mounting means 62. It may be desirable that mounting means 62 be detachable from hull 15 so that personal cooling device 31 may be easily removed from watercraft 11.

Quick-release connector 63 is coupled between pump member 61 and intake conduit 65. Intake conduit 65 is preferably a conventional flexible hose having an inside diameter of about 0.5 inches. Intake conduit terminates opposite pump member 61 with a screen member 67 having a tubular portion 67*a* and an end cap 67*b*. Tubular portion 67*a* is preferably about four inches long, has an inside diameter of about 0.75 inches, and is made of polyvinyl chloride (PVC) pipe embedded with metallic fragments to add weight. Tubular portion 67*a* includes a plurality of perforations 67*c* through which water from body of water 13 may be drawn into intake conduit 65 by pump member 61. Perforations 67*c* filter large solids from body of water 13. It is preferred that end cap 67*b* also be made of PVC embedded with metallic fragments. It is necessary that intake conduit be long enough to extend from pump member 61, over hull 15, and into body of water 13 to a depth sufficient to completely cover screen member 67. This ensures that a minimum amount of air is drawn through screen member 67. Quick-release connector 63 allows intake conduit 65 and screen member 67 to be quickly disconnected from mist assembly 39 and brought into watercraft 11 and stowed. This would be done, for example, when it is desirable to travel in watercraft 11 at high speeds, or when watercraft 11 is removed from body of water 13.

Figure 3:
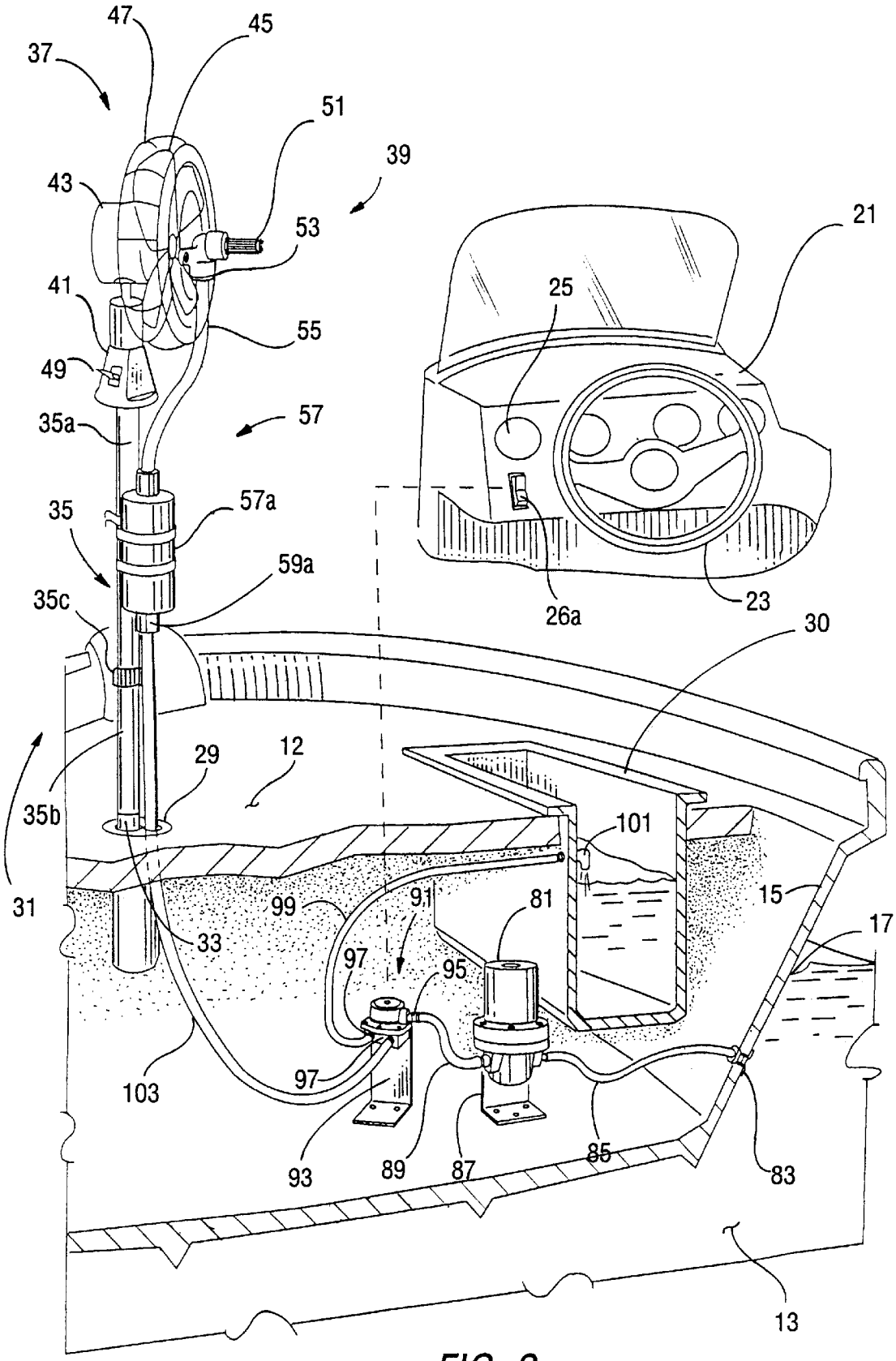
FIG. 3 is a perspective view in partial cross-section of an alternate embodiment of the passenger cooling device for watercraft of FIG. 2.

Referring now to FIG. 3 in the drawings, an alternate embodiment of the passenger cooling device for watercraft of the present invention is illustrated. In this embodiment, connector 33, mast 35, and fan member 37 are identical in form and function as those described above and illustrated in FIGS. 1 and 2. However, in this alternate embodiment, mist assembly 39 remains operably associated with fan member 37, but is operated and controlled in a different manner. Pump member 61 of FIG. 2 has been replaced with an existing pump member 81. Pump member 81 is used on watercraft 11 to fill reservoir 30 with water from body of water 13. In a conventional manner, pump member 81 draws the water through an inlet port 83 and an intake conduit 85. Inlet port 83 passes through hull 15 at a location below water line 17. In a typical installation, pump member 81 is powered by power source 27 and controlled by switch 26 (see FIG. 1) on console 21. Pump member 81 is optionally coupled to hull 15 by a support means 87. Pump member 81 forces the water through an outlet conduit 89 that extends from pump member 81 to a conventional switch valve 91 that is preferably coupled to hull 15 by a support means 93. Switch valve 91 is powered by power source 27 (see FIG. 1) and operated by a switch 26*a* on console 21, in a manner similar to the operation of pump member 81.

Switch valve 91 includes an inlet port 95 and a plurality of outlet ports 97. One outlet port 97 is coupled to a feeder conduit 99 that extends from switch valve 91 to reservoir 30. Feeder conduit 99 is coupled to a spout member 101 for filling reservoir 30 with water from body of water 13. Each remaining outlet port 97 is coupled to a flexible conduit 103 that extends from switch valve 91 to filter member 57 of each individual mist assembly 39 of each individual passenger cooling device 31. Switch valve 91 allows the operator to direct the water from body of water 13 to either reservoir 30 or passenger cooling devices 31. In this manner, a single switch valve 91 can supply multiple passenger cooling devices 31. It should be understood that for watercraft 11 having multiple electrical receptacles 29, switch valve 91 may be adapted to allow the operator to activate passenger cooling devices 31 either all at once or in selected combinations.

In instances when watercraft 11 includes an upper deck 12, it is preferred that intake conduit 85, pump member 81, support means 87, outlet conduit 89, switch valve 91, support means 93, and feeder conduit 99 all be concealed beneath upper deck 12. As is shown, flexible conduits 103 are only partially concealed beneath upper deck 12, and are not separated by a quick-release connector, such as quick-release connector 63 (see FIG. 2). Thus, FIG. 3 represents a passenger cooling device 31 in a "semi-permanent" installation in which fan member 37 and mist assembly 39 may be removed from electrical receptacle 29 and stowed nearby, but not completely removed from watercraft 11. It should be understood that flexible conduits 103 may be easily adapted to include quick-release connectors, such as quick-release connector 63 (see FIG. 2) to allow complete removal of each passenger cooling device in a quick and easy manner.

In operation, one or more passenger cooling devices 31 are installed into conventional electrical receptacles 29 on watercraft 11. It may be necessary to detach one or more running lights or other detachable electrical components. In this manner, passenger cooling devices 31 are powered by power supply 27 of watercraft 11. This provides for a relatively long operational life of passenger cooling devices 31, particularly when power supply 27 is charged during the operation of watercraft 11. Connectors 33 are adapted to releasably secure passenger cooling devices 31 within receptacles 29. Depending upon the desired cooling effect, fan members 37 may be oscillating or stationary. In addition, the vertical position of fan member 37 may be altered by adjusting the height of telescopic mast 35. The adjusted height of mast 35 is secured by tightening fastening means 35*c*.

Assembly of passenger cooling device 31 is completed by coupling intake conduit 65 and screen member 67 to pump means 61 via quick-release connector 63. Screen member 67 is tossed overboard into body of water 13 and allowed to sink to a depth sufficient to cover screen member 67. Once installed and adjusted, passenger cooling devices 31 are controlled by the operator by switches 26 on console 21. Fan member 37 and pump means 61 are then switched on, either in conjunction, or independently. Pump means 61 draws water from body of water 13 and pumps it through atomizing nozzle 51. Screen member 67 and filter member 57 work together to filter solids from the water. Because pump means 61 is an "on-demand" type pump, the filtered water is supplied to atomizing nozzle 51 at a constant pressure. Passenger cooling device 31 uninstalls quickly and easily.

Should the operator decide to operate watercraft at high speed, change locations, or remove watercraft 11 from body of water 13, pump means 61 and fan member 37 are turned off, and intake conduit 65 and screen member 67 are disconnected from pump means 61 at quick-release connector 63 and brought into watercraft 11.

Because nozzle 51 is operably associated with fan member 37, water mist emitted from nozzle 51 is blown by fan member 37 toward the passengers. The passengers are cooled by the moist air flow. Personal cooling devices 31 may create a cooling effect of about 20° F.

An invention has been provided with several advantages. The device of the invention is simple in design and economical to manufacture. The device can cool several people at once. The detachable nature of the fan mast allows it to be stored when the craft is in motion or when not in use. By using the surrounding lake water as the water source and the electrical power supply is taken from the watercraft's existing power supply, the device can run for hours without the necessity of refilling a reservoir or charging a battery or other power supply.

It should be apparent from the foregoing that an invention having significant advantages has been provided. While the invention is shown in a limited number of forms, it is not limited to just these forms, but is susceptible to various changes and modifications without departing from the spirit thereof.

I claim:

1. A detachable passenger cooling device for use on a watercraft having an electrical receptacle for receiving detachable electrical components, the detachable passenger cooling device comprising:

an electric fan;

an electrical connector conductively coupled to the electric fan, the electrical connector being adapted to be detachably received by the electrical receptacle;

a nozzle operably associated with the electric fan; and a pump for pumping water from a water supply through the nozzle.

2. The detachable passenger cooling device according to claim 1, further comprising:

a filter member disposed between the pump and the nozzle for filtering the water.

3. The detachable passenger cooling device according to claim 1, further comprising:

a connector for releasably connecting the electric fan to an existing electrical power source of the watercraft.

4. The detachable passenger cooling device according to claim 3, wherein the connector is adapted to be received in an electrical receptacle for a detachable running light.

5. The detachable passenger cooling device according to claim 1, wherein the electric fan may operate independently of the nozzle.

6. The detachable passenger cooling device according to claim 1, wherein an intake conduit is coupled to the pump by a quick-release connector, whereby the intake conduit may be retrieved from the body of water when the passenger cooling device is not in use.

7. The detachable passenger cooling device according to claim 6, wherein the intake conduit includes a screening member for filtering solids from the water.

8. The detachable passenger cooling device according to claim 1, wherein the electric fan includes an oscillating fan.

9. The detachable passenger cooling device according to claim 1, wherein the electric fan includes a stationary fan.

10. The detachable passenger cooling device according to claim 2, wherein the filter member comprises:

a filter housing; and a replaceable filter cartridge carried by the filter housing.

11. The detachable passenger cooling device according to claim 1, further comprising:

a switch member disposed on a console of the watercraft to control the detachable passenger cooling device.

12. The detachable passenger cooling device according to claim 1, wherein the electric fan comprises:

a plurality of fan blades;

an electric fan motor for driving the plurality of fan blades; and an adjustable mast for supporting the electric fan;

wherein the electrical connector is carried at an end of the adjustable mast opposite the electric fan.

13. The detachable passenger cooling device according to claim 12, wherein the adjustable mast is telescopic to adjust the height of the electric fan and rotatable to adjust the direction of the electric fan.

14. The detachable passenger cooling device according to claim 1, wherein the water supply is a body of water in which the watercraft is afloat.

15. The detachable passenger cooling device according to claim 1, wherein the water supply is a container carried by the watercraft.

16. A cooling apparatus for use in a watercraft having a reservoir for holding water from a body of water in which the watercraft is afloat, the cooling apparatus comprising:

a cooling fan assembly;

a pump member for supplying the water to the cooling fan assembly and the reservoir; and a switch valve for selectively determining whether the water is pumped by the pump member into the reservoir or to the cooling fan assembly.

17. The cooling apparatus according to claim 16, wherein the cooling fan assembly comprises:

an electric fan;

an electrical connector for detachably connecting the electric fan to a power supply of the watercraft;

an atomizing nozzle for making a mist from the water, the atomizing nozzle being operably associated with the electric fan member; and a filter member disposed between the atomizing nozzle and the pump member for filtering the water.

18. The cooling apparatus according to claim 16, wherein the fan assembly is adapted to be received in an electrical receptacle for a detachable running light.

19. The passenger cooling device according to claim 17, wherein the electric fan may operate independent of the atomizing nozzle.

20. The passenger cooling device according to claim 16, wherein the pump member and the switch valve are disposed below an upper deck of the watercraft.

* * * * *